US005667636A

United States Patent [19]

Engel et al.

[11] Patent Number: 5,667,636

[45] Date of Patent: Sep. 16, 1997

[54] METHOD FOR MAKING SMOOTH UNCREPED THROUGHDRIED SHEETS

[75] Inventors: Steven Alexander Engel, Neeah; Michael John Rekoske; Theodore Edwin Farrington, Jr., both of Appleton, all of Wis.; Stephen John Sudall, Wales, United Kingdom; Paul Edward Williams, Chester, England; David Arthur Hyland, Clwyd, United Kingdom

[73] Assignee: Kimberly-Clark Worldwide, Inc., Neenah, Wis.

[21] Appl. No.: 330,166

[22] Filed: Oct. 27, 1994

Related U.S. Application Data

[63] Continuation-in-part of Ser. No. 36,649, Mar. 24, 1993, abandoned.

[51] Int. Cl.[6] ..... D21H 11/00

[52] U.S. Cl. ..... 162/117; 162/109

[58] Field of Search ..... 162/111, 112, 162/113, 188, 123, 117, 374, 115; 428/153, 154

[56] References Cited

U.S. PATENT DOCUMENTS

| | | | |
|---|---|---|---|
| 3,301,746 | 1/1967 | Sanford et al. | 162/113 |
| 3,537,954 | 11/1970 | Justus | 162/305 |
| 3,629,056 | 12/1971 | Forrest | 162/305 |
| 3,692,622 | 9/1972 | Dunning | 161/124 |
| 3,726,750 | 4/1973 | Stillings | 161/57 |
| 3,776,807 | 12/1973 | Dunning et al. | 161/124 |
| 3,806,406 | 4/1974 | Ely | 162/206 |
| 3,812,000 | 5/1974 | Salvacci, Jr. et al. | 162/111 |
| 3,821,068 | 6/1974 | Shaw | 162/111 |
| 3,846,228 | 11/1974 | Ely et al. | 162/206 |
| 3,905,863 | 9/1975 | Ayers | 162/113 |
| 3,926,716 | 12/1975 | Bates | 162/113 |
| 3,974,025 | 8/1976 | Ayers | 162/113 |
| 3,994,771 | 11/1976 | Morgan, Jr. et al. | 162/113 |
| 4,072,557 | 2/1978 | Schiel | 162/111 |
| 4,087,319 | 5/1978 | Linkletter | 162/113 |
| 4,100,017 | 7/1978 | Flautt, Jr. | 162/111 |
| 4,102,737 | 7/1978 | Morton | 162/113 |
| 4,120,747 | 10/1978 | Sarge, III et al. | 162/117 |
| 4,125,430 | 11/1978 | Grossman | 162/207 |
| 4,125,659 | 11/1978 | Klowak et al. | 428/153 |
| 4,127,637 | 11/1978 | Pietreniak et al. | 264/114 |
| 4,157,938 | 6/1979 | Clemens et al. | 162/207 |
| 4,191,609 | 3/1980 | Trokhan | 162/113 |
| 4,196,045 | 4/1980 | Ogden | 162/117 |
| 4,309,246 | 1/1982 | Hulit et al. | 162/113 |
| 4,440,597 | 4/1984 | Wells et al. | 162/111 |
| 4,448,638 | 5/1984 | Klowak | 162/111 |
| 4,464,224 | 8/1984 | Matolcsy | 162/111 |
| 4,469,735 | 9/1984 | Trokhan | 428/154 |

(List continued on next page.)

FOREIGN PATENT DOCUMENTS

| | | |
|---|---|---|
| 342646 | 11/1989 | European Pat. Off. . |
| 0617164 | 9/1994 | European Pat. Off. . |
| 1573109 | 7/1969 | France . |
| 1 212 473 | 11/1970 | United Kingdom . |
| 2105091 | 5/1972 | United Kingdom . |
| 2 279 372 | 1/1995 | United Kingdom . |
| 2 288 614 | 10/1995 | United Kingdom . |

OTHER PUBLICATIONS

Modern Pulp and Paper making, Third Edition, Reinhold Publishing Corp. (New York, N.Y.) 1957 pp. 312–313.

*Primary Examiner*—Brenda A. Lamb
*Attorney, Agent, or Firm*—Gregory E. Croft

[57] ABSTRACT

Uncreped throughdried cellulosic webs having improved smoothness and stretch are produced by transferring a newly formed web from the forming fabric to a slower moving, high fiber support transfer fabric, preferably using a fixed gap or kiss transfer in which the forming fabric and the transfer fabric converge and diverge at the leading edge of the transfer shoe. The web is then transferred to a through-drying fabric and throughdried to final dryness, producing a web having an improved softness due to increased surface smoothness.

9 Claims, 3 Drawing Sheets

U.S. PATENT DOCUMENTS

| | | | |
|---|---|---|---|
| 4,529,480 | 7/1985 | Trokhan | 162/109 |
| 4,551,199 | 11/1985 | Weldon | 162/109 |
| 4,556,450 | 12/1985 | Chuang et al. | 162/204 |
| 4,637,859 | 1/1987 | Trokhan | 162/109 |
| 4,808,266 | 2/1989 | Faurie | 162/102 |
| 4,940,513 | 7/1990 | Spendel | 162/112 |
| 4,959,125 | 9/1990 | Spendel | 162/158 |
| 5,048,589 | 9/1991 | Cook et al. | 162/109 |
| 5,059,282 | 10/1991 | Ampulski et al. | 162/111 |
| 5,098,519 | 3/1992 | Kamasubramanian et al. | 162/109 |
| 5,098,522 | 3/1992 | Smurkoski et al. | 162/358 |
| 5,126,015 | 6/1992 | Pounder | 162/206 |
| 5,137,600 | 8/1992 | Barnes et al. | 162/115 |

METHOD FOR MAKING SMOOTH UNCREPED THROUGHDRIED SHEETS

This application is a continuation-in-part of U.S. Ser. No. 08/036,649, filed Mar. 24, 1993 now abandoned.

BACKGROUND OF THE INVENTION

In the manufacture of paper products such as tissues, towels, wipers and the like, a wide variety of product characteristics must be given attention in order to provide a final product with the appropriate blend of attributes suitable for the product's intended purpose. Among these various attributes, improving surface feel, strength, absorbency, bulk and stretch have always been major objectives. Traditionally, many of these paper products have been made using a wet-pressing process in which a significant amount of water is removed from a wet laid web by pressing or squeezing water from the web prior to final drying. In particular, while supported by an absorbent papermaking felt, the web is squeezed between the felt and the surface of a rotating heated cylinder (Yankee dryer) using a pressure roll as the web is transferred to the surface of the Yankee dryer for final drying. The dried web is thereafter dislodged from the Yankee dryer with a doctor blade (creping), which serves to partially debond the dried web by breaking many of the bonds previously formed during the wet-pressing stages of the process. Creping can greatly improve the feel of the web, but at the expense of a significant loss in strength.

More recently, throughdrying has become an alternate means of drying paper webs. Throughdrying provides a relatively noncompressive method of removing water from the web by passing hot air through the web until it is dry. More specifically, a wet-laid web is transferred from the forming fabric to a coarse, highly permeable throughdrying fabric and retained on the throughdrying fabric until dry. The resulting dried web is softer and bulkier than a conventionally-dried uncreped sheet because fewer bonds are formed and because the web is less compressed. Squeezing water from the wet web is eliminated, although the use of a pressure roll to subsequently transfer the web to a Yankee dryer for creping may still be used.

While there is a processing incentive to eliminate the Yankee dryer and make an uncreped throughdried product, uncreped throughdried sheets are typically quite harsh and rough to the touch compared to their creped counterparts. This is partially due to the inherently high stiffness and strength of an uncreped sheet, but is also in part due to the coarseness of the throughdrying fabric onto which the wet web is conformed and dried.

Therefore there is a need for a method for making an uncreped throughdried paper web which can provide improved combinations of sheet properties for a variety of different products.

SUMMARY OF THE INVENTION

It has now been discovered that an improved uncreped throughdried web can be made by transferring the wet web from a forming fabric to one or more intermediate transfer fabrics before further transferring the web to the throughdrying fabric for drying of the web. The intermediate transfer fabric(s) is(are) traveling at a slower speed than the forming fabric during the transfer in order to impart stretch into the sheet. As the speed differential between the forming fabric and the slower transfer fabric is increased (sometimes referred to as "negative draw" or "rush transfer"), the stretch imparted to the web during transfer is also increased. The transfer fabric can be relatively smooth and dense compared to the coarse weave of a typical throughdrying fabric. Preferably the transfer fabric is as fine as can be run from a practical standpoint. Gripping of the web is accomplished by the presence of knuckles on the surface of the transfer fabric. In addition, it can be advantageous if one or more of the wet web transfers, with or without the presence of a transfer fabric, are achieved using a "fixed gap" or "kiss" transfer in which the fabrics simultaneously converge and diverge, which will be hereinafter described in detail. Such transfers not only avoid any significant compaction of the web while it is in a wet bond-forming state, but when used in combination with a differential speed transfer and/or a smooth transfer fabric, are observed to smoothen the surface of the web and final dry sheet.

Hence, in one aspect the invention resides in a method of making a noncompressively-dried cellulosic web comprising: (a) depositing an aqueous suspension of papermaking fibers onto the surface of an endless traveling foraminous forming fabric to form a wet web having a consistency of from about 15 to about 25 weight percent; (b) transferring the wet web to a transfer fabric (hereinafter described) traveling at a speed from about 5 to about 75 percent slower than the forming fabric to impart stretch into the web; and (c) transferring the web to a drying fabric, preferably a throughdrying fabric, whereon the web is dried to final dryness in an uncreped state. This method provides a means for producing webs with improved smoothness, stretch and relatively high caliper or thickness, as measured from one side of the web to another, particularly at relatively low basis weights.

When carrying out a rush transfer, the transfer is carried out such that the resulting "sandwich" (consisting of the forming fabric/web/transfer fabric) exists for as short a duration as possible. In particular, it exists only at the leading edge of the vacuum shoe or transfer shoe slot being used to effect the transfer. In effect, the forming fabric and the transfer fabric converge and diverge at the leading edge of the vacuum slot. The intent is to minimize the distance over which the web is in simultaneous contact with both fabrics. It has been found that simultaneous convergence/divergence is the key to eliminating macrofolds and thereby enhances the smoothness of the resulting tissue or other product.

In practice, the simultaneous convergence and divergence of the two fabrics will only occur at the leading edge of the vacuum slot if a sufficient angle of convergence is maintained between the two fabrics as they approach the leading edge of the vacuum slot and if a sufficient angle of divergence is maintained between the two fabrics on the downstream side of the vacuum slot. The minimum angles of convergence and divergence are about 0.5° or greater, more specifically about 1° or greater, more specifically about 2° or greater, and still more specifically about 5° or greater. The angles of convergence and divergence can be the same or different. Greater angles provide a greater margin of error during operation. A suitable range is from about 1° to about 10°. Simultaneous convergence and divergence is achieved when the vacuum shoe is designed with the trailing edge of the vacuum slot being sufficiently recessed relative to the leading edge to permit the fabrics to immediately diverge as they pass over the leading edge of the vacuum slot. This will be more clearly described in connection with the Drawing.

If setting up the machine with the fabrics initially having a fixed gap to further minimize compression of the web during the transfer, the distance between the fabrics should be equal to or greater than the thickness or caliper of the web so that the web is not significantly compressed when transferred at the leading edge of the vacuum slot.

In another aspect, the invention resides in a method of making a noncompressively-dried cellulosic web comprising: (a) depositing an aqueous suspension of papermaking fibers onto the surface of an endless traveling foraminous forming fabric to form a wet web having a consistency of from about 15 to about 25 weight percent; (b) transferring the wet web to a drying fabric, preferably a throughdrying fabric, traveling at a speed from about 5 to about 75 percent slower than the forming fabric by passing the web over a vacuum shoe having a vacuum slot with a leading and trailing edge, wherein the forming fabric and the drying fabric converge and diverge at the leading edge of the vacuum slot at an angle of about 0.5° or greater; and (c) noncompressively drying the web.

The forming process and tackle can be conventional as is well known in the papermaking industry. Such formation processes include Fourdrinier, roof formers (such as suction breast roll), and gap formers (such as twin wire formers, crescent formers) etc. Forming wires or fabrics can also be conventional, the finer weaves with greater fiber support being preferred to produce a more smooth sheet or web. Headboxes used to deposit the fibers onto the forming fabric can be layered or nonlayered.

The basis weights of the webs of this invention can be any weight suitable for use as a paper towel or wiper. Such webs can have a basis weight of from about 15 to about 60 grams per square meter, more suitably from about 20 to about 30 grams per square meter.

As used herein, "transfer fabric" is a fabric which is positioned between the forming section and the drying section of the web manufacturing process. Suitable transfer fabrics are those papermaking fabrics which provide a high fiber support index and provide a good vacuum seal to maximize fabric/sheet contact during transfer from the forming fabric. The fabric can have a relatively smooth surface contour to impart smoothness to the web, yet must have enough texture to grab the web and maintain contact during a rush transfer. Finer fabrics can produce a higher degree of stretch in the web, which is desireable for some product applications.

Transfer fabrics include single-layer, multi-layer, or composite permeable structures. Preferred fabrics have at least some of the following characteristics: (1) On the side of the transfer fabric that is in contact with the wet web (the top side), the number of machine direction (MD) strands per inch (mesh) is from 10 to 200 and the number of cross-machine direction (CD) strands per inch (count) is also from 10 to 200. The strand diameter is typically smaller than 0.050 inch; (2) On the top side, the distance between the highest point of the MD knuckle and the highest point of the CD knuckle is from about 0.001 to about 0.02 or 0.03 inch. In between these two levels, there can be knuckles formed either by MD or CD strands that give the topography a 3-dimensional characteristic; (3) On the top side, the length of the MD knuckles is equal to or longer than the length of the CD knuckles; (4) If the fabric is made in a multi-layer construction, it is preferred that the bottom layer is of a finer mesh than the top layer so as to control the depth of web penetration and to maximize fiber retention; and (5) The fabric may be made to show certain geometric patterns that are pleasing to the eye, which typically repeat between every 2 to 50 warp yarns.

Specific suitable transfer fabrics include, by way of example, those made by Asten Forming Fabrics, Inc., Appleton, Wis. and designated as numbers 934, 937, 939 and 959. The void volume of the transfer fabric can be equal to or less than the fabric from which the web is transferred.

The speed difference between the forming fabric and the transfer fabric can be from about 5 to about 75 percent or greater, preferably from about 10 to about 35 percent, and more preferably from about 15 to about 25 percent, the transfer fabric being the slower fabric. The optimum speed differential will depend on a variety of factors, including the particular type of product being made. As previously mentioned, the increase in stretch imparted to the web is proportional to the speed differential. For an uncreped throughdried three-ply wiper having a basis weight of about 20 grams per square meter per ply, for example, a speed differential in the production of each ply of from about 20 to about 25 percent between the forming fabric and a sole transfer fabric produces a stretch in the final product of from about 15 to about 20 percent.

The stretch can be imparted to the web using a single differential speed transfer or two or more differential speed transfers of the wet web prior to drying. Hence there can be one or more transfer fabrics. The amount of stretch imparted to the web can hence be divided among one, two, three or more differential speed transfers.

The drying process can be any noncompressive drying method which tends to preserve the bulk or thickness of the wet web including, without limitation, throughdrying, infrared irradiation, microwave drying, etc. Because of its commercial availability and practicality, throughdrying is a well-known and preferred means for noncompressively drying the web. Suitable throughdrying fabrics include, without limitation, Asten 920A and 937A, and Velostar P800 and 103A. The web is preferably dried to final dryness without creping, since creping tends to lower the web strength and bulk.

While the mechanics are not completely understood, it is clear that the transfer fabric and throughdrying fabric can make separate and independent contributions to final sheet properties. For example, sheet surface smoothness as determined by a sensory panel can be manipulated over a broad range by changing transfer fabrics with the same throughdrying fabric. Webs produced via this invention tend to be very two-sided unless calendered. Uncalendered webs may, however, be plied together with smooth/rough sides out as required by specific product forms.

DETAILED DESCRIPTION OF THE INVENTION

Figure 1:
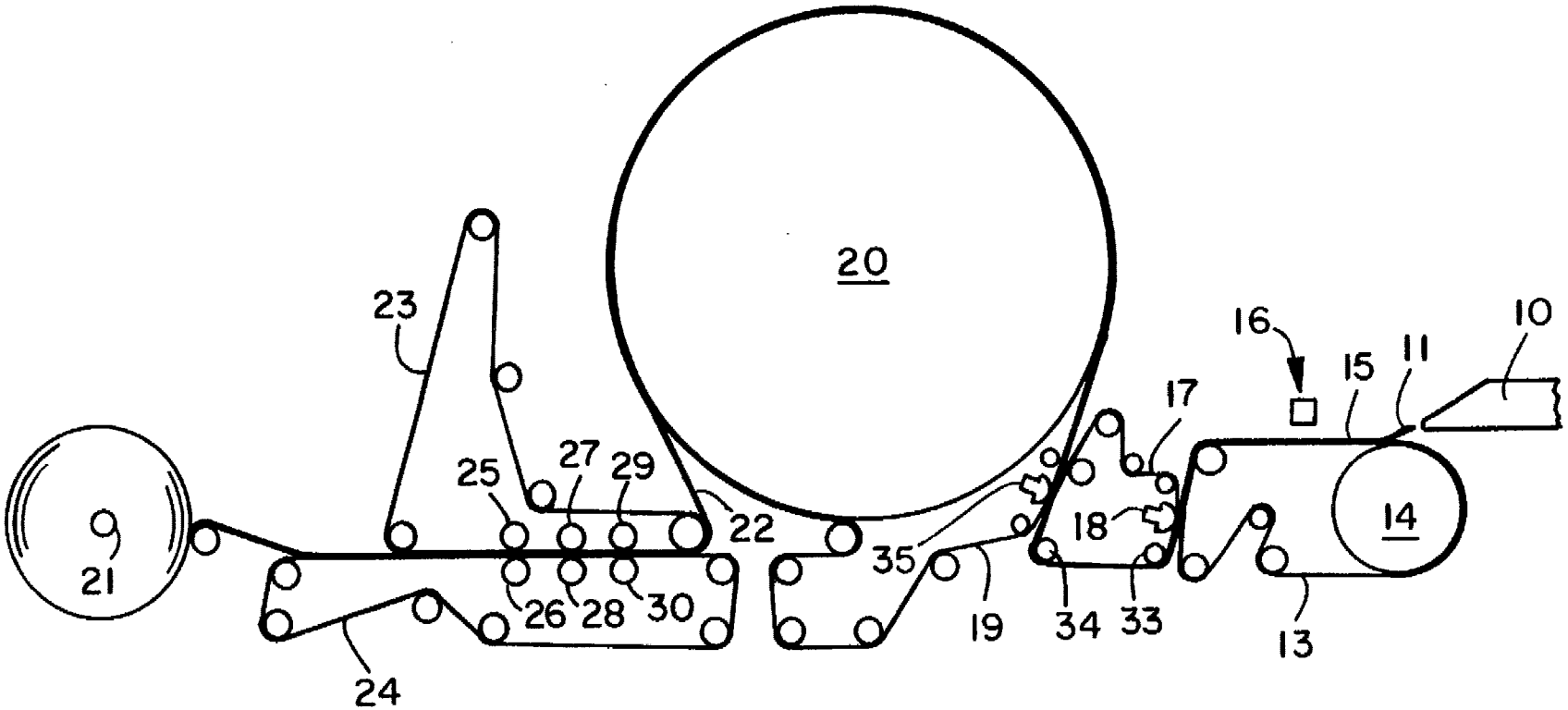
FIG. 1 is a schematic process flow diagram illustrating a method of making uncreped throughdried sheets in accordance with this invention.

Directing attention to the Drawing, the invention will be described in further detail.

FIG. 1 illustrates a means for carrying out the method of this invention. (For simplicity, the various tensioning rolls schematically used to define the several fabric runs are shown but not numbered.) Shown is a papermaking headbox 10 which injects or deposits a stream 11 of an aqueous suspension of papermaking fibers onto the forming fabric 13 which serves to support and carry the newly-formed wet web downstream in the process as the web is partially dewatered to a consistency of about 10 dry weight percent.

After formation, the forming fabric carries the wet web 15 to an optional hydroneedling station 16 where the web can be hydroneedled to increase its bulk. Suitable means for hydroneedling are disclosed in U.S. Pat. No. 5,137,600 issued Aug. 11, 1992 to Barnes et al. and entitled "Hydraulically Needled Nonwoven Pulp Fiber Web", which is herein incorporated by reference. Such means provide a multiplicity of pressurized water jets which impinge upon the surface of the newly-formed wet web while supported on the forming fabric, causing an increase in the porosity of the web and hence an increase in bulk.

Whether or not the optional hydroneedling operation is used, additional dewatering of the wet web can be carried out, such as by vacuum suction, while the wet web is supported by the forming fabric. The Fourdrinier former illustrated is particularly useful for making the heavier basis weight sheets useful as wipers and towels, although other forming devices can be used.

The wet web is then transferred from the forming fabric to a transfer fabric 17 traveling at a slower speed than the forming fabric in order to impart increased stretch into the web. Transfer is preferably carried out with the assistance of a vacuum shoe 18 as described hereinafter with reference to FIG. 3.

The transfer fabric passes over rolls 33 and 34 before the wet web is transferred to a throughdrying fabric 19 traveling at about the same speed, or a different speed if desired. Transfer is effected by vacuum shoe 35, which can be of the same design as that used for the previous transfer. The web is dried to final dryness as the web is carried over a throughdryer 20.

Prior to being wound onto a reel 21 for subsequent conversion into the final product form, the dried web 22 can be carried through one or more optional fixed gap fabric nips formed between carrier fabrics 23 and 24. The bulk or caliper of the web can be controlled by fabric embossing nips formed between rolls 25 and 26, 27 and 28, and 29 and 30. Suitable carrier fabrics for this purpose are Albany International 84M or 94M and Asten 959 or 937, all of which are relatively smooth fabrics having a fine pattern. Nip gaps between the various roll pairs can be from about 0.001 inch to about 0.02 inch. As shown, the carrier fabric section of the machine is designed and operated with a series of fixed gap nips which serve to control the caliper of the web and can replace or compliment off-line calendering. Alternatively, a reel calender can be employed to achieve final caliper or complement off-line calendering.

Figure 2:
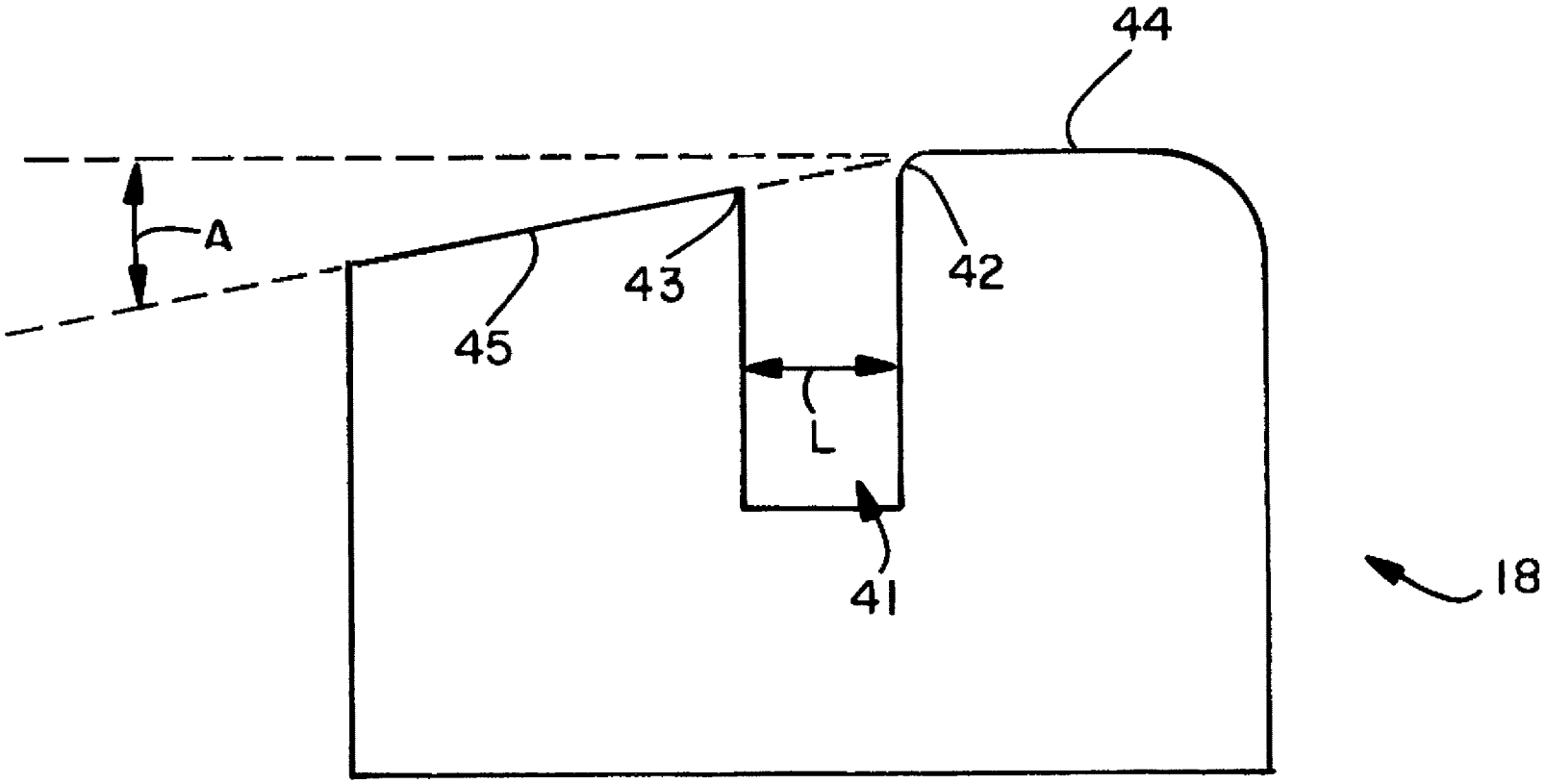
FIG. 2 is a schematic diagram of a transfer shoe useful for carrying out the method of this invention.

FIG. 2 more clearly illustrates the design of the transfer shoe used in the transfer fabric section of the process disclosed in FIG. 1. Shown is the transfer shoe 18 having a vacuum slot 41 having a length of "L" which is suitably connected to a source of vacuum. The length of the vacuum slot can be from about 0.5 to about 1 inch. For producing uncreped throughdried bath tissue, a suitable vacuum slot length is about 1 inch. The vacuum slot has a leading edge 42 and a trailing edge 43. Correspondingly, the transfer shoe has an incoming land area 44 and an outgoing land area 45. Note that the trailing edge of the vacuum slot is recessed relative to the leading edge, which is caused by the different orientation of the outgoing land area relative to that of the incoming land area. The angle "A" between the planes of the incoming land area and the outgoing land area can be about 0.5° or greater, more specifically about 1° or greater, and still more specifically about 5° or greater in order to provide sufficient separation of the forming fabric and the transfer fabric as they are converging and diverging as described below.

Figure 3:
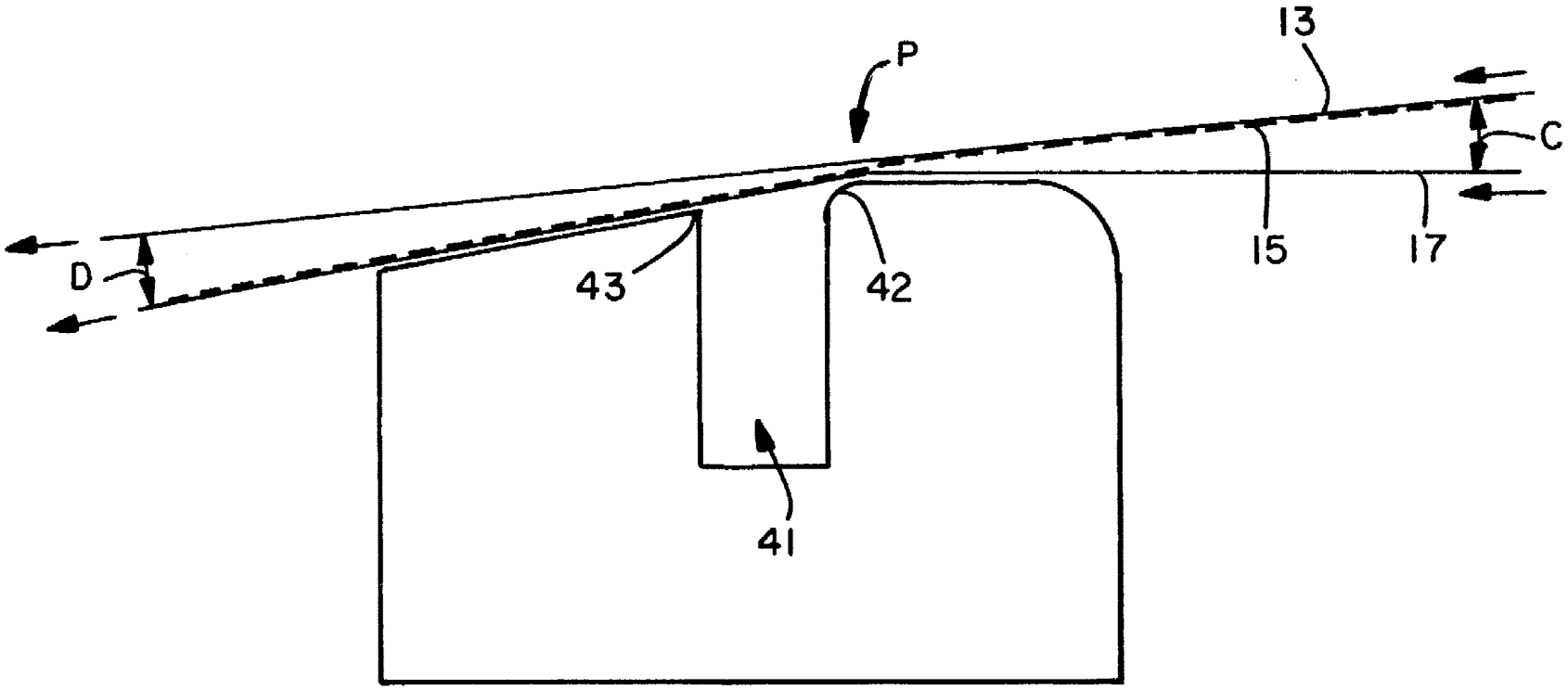
FIG. 3 is a schematic diagram of the transfer section illustrating the simultaneous convergence and divergence of the fabrics at the leading edge of the vacuum slot.

FIG. 3 further illustrates the transfer of the wet tissue web from the forming fabric 13 carrying the wet web 15 as it approaches the transfer shoe traveling in the direction shown by the arrow. Also approaching the transfer shoe is the transfer fabric 17 traveling at a slower speed. The angle of convergence between the two incoming fabrics is designated as "C". The angle of divergence between the two fabrics is designated as "D". As shown, the two fabrics simultaneously converge and diverge at point "P", which corresponds to the leading edge 42 of the vacuum slot. It is not necessary or desireable that the web be in contact with both fabrics over the entire length of the vacuum slot to effect the transfer from the forming fabric to the transfer fabric. As previously described, minimizing the distance during which the web is in contact with both fabrics reduces or eliminates the presence of macrofolds in the resulting tissue. As is apparent from FIG. 3, neither the forming fabric or the transfer fabric need to be deflected more than a small amount to carry out the transfer, which can reduce fabric wear. Numerically, the change in direction of either fabric can be less than 5°.

The surface of the transfer fabric is relatively smooth in order to provide smoothness to the wet web. The openness of the transfer fabric, as measured by its void volume, is relatively low and can be about the same as that of the forming fabric or even lower.

As previously mentioned, the transfer fabric is traveling at a slower speed than the forming fabric. The speed differential is preferably from about 20 to about 30 percent, based on the speed of the forming fabric. If more than one transfer fabric is used, the speed differential between fabrics can be the same or different. Multiple transfer fabrics can provide operational flexibility as well as a wide variety of fabric/speed combinations to influence the properties of the final product.

The level of vacuum used for the differential speed transfers can be from about 3 to about 15 inches of mercury, preferably about 5 inches of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

EXAMPLES

Example 1

(This invention). In order to further illustrate the invention, an uncreped throughdried web was made using the method illustrated in FIG. 1. More specifically, an aqueous suspension of 100% secondary papermaking fibers was prepared containing about 0.2 weight percent fibers. The fiber suspension was fed to a Fourdrinier headbox and deposited onto the forming fabric. The forming fabric was an Asten 866 having a void volume of 64.5%. The speed of the forming fabric was 862 feet per minute. The newly-formed web was dewatered to a consistency of about 20 weight percent using vacuum suction from below the forming fabric before being transferred to the transfer fabric, which was traveling at a speed of about 750 feet per minute (15% differential speed). The transfer fabric was an Asten 959 having a void volume of 59.9%. A fixed gap of about 0.635 millimeter was initially provided between the forming fabric and the transfer fabric at the point of transfer at the leading edge of the transfer shoe, the fixed gap being slightly wider than the thickness of the wet web at that point in the process to allow for sheet expansion while transferring. A vacuum shoe pulling a vacuum of 5 inches of mercury was used to make the transfer without compacting the wet web. The web was then transferred to a 920A throughdrying fabric traveling at a speed of 750 feet per minute. The angle of convergence was about 0.5° and the angle of divergence was about 1°. The web was carried over a Honeycomb throughdryer operating at a temperature of about 350° F. and dried to final dryness (about 2 percent moisture). The resulting basesheet was wound into a softroll and exhibited the following properties: basis weight, 22 grams per square meter (gsm); geometric mean tensile strength, 2188 grams per 3 inches width (grams).

Example 2

(This invention). An uncreped throughdried sheet was made as described in Example 1, except that the speed of the forming fabric was 810 feet per minute (8% speed differential). The resulting properties of the basesheet were as follows: basis weight, 21 gsm; geometric mean tensile strength, 1476 grams.

Example 3

(This invention). An uncreped throughdried sheet was made as described in Example 1, except that the newly-formed sheet was hydroneedled to improve the absorbent wicking of the sheet. The properties of the resulting sheet were as follows: basis weight, 22 gsm; geometric mean tensile strength, 1901 grams.

Example 4

(This invention). An uncreped throughdried sheet was made as described in Example 2, except the newly-formed web was hydroneedled as previously described. The properties of the resulting sheet were as follows: basis weight, 21 gsm; geometric mean tensile strength, 1476 grams.

Example 5

For comparison, an uncreped throughdried sheet was made similarly as described in Example 1, but without a transfer fabric and without a fixed gap transfer. Instead, the transfer fabric was replaced with a typical throughdryer fabric (Asten 920A) and the differential speed relative to the forming fabric was 20% slower. The resulting web had the following properties: basis weight, 16 gsm; geometric mean tensile strength, 2056 grams.

As shown by the previous Examples, the use of a transfer fabric as herein defined can produce a smoother sheet.

It will be appreciated that the foregoing examples, given for purposes of illustration, are not to be construed as limiting the scope of the invention, which is defined by the following claims and all equivalents thereto.

We claim:

1. A method of making a cellulosic web comprising:

(a) depositing an aqueous suspension of papermaking fibers onto the surface of an endless traveling foraminous forming fabric to form a wet web having a consistency of from about 15 to about 25 percent;

(b) transferring the wet web from the forming fabric to a first transfer fabric having a void volume that is equal to or less than the void volume of the forming fabric, said transfer fabric traveling at a speed of from about 5 to about 75 percent slower than the forming fabric; and (c) transferring the wet web from the first transfer fabric to a throughdrying fabric, wherein the web is throughdried.

2. The method of claim 1 wherein the throughdried web is transferred from the throughdrying fabric to a relatively smooth carrier fabric and thereafter compressed in a fixed gap between the carrier fabric and another relatively smooth fabric to control and reduce the caliper of the dried web.

3. The method of claim 2 wherein the throughdried web is compressed in two or more fixed gaps, each successive fixed gap being smaller than the previous fixed gap.

4. The method of claim 2 wherein the throughdried web is compressed in three or more fixed gaps.

5. The method of claim 1 wherein the wet web is transferred from the first transfer fabric to a second transfer fabric prior to throughdrying.

6. The method of claim 5 wherein the second transfer fabric is traveling at a slower speed than the first transfer fabric.

7. The method of claim 1 wherein the wet web is transferred from the forming fabric to the first transfer fabric with using a transfer shoe having a vacuum slot, wherein the forming fabric and the transfer fabric converge and diverge at the edge of the vacuum slot first encountered by the web.

8. The method of claim 7 wherein the drying fabric is a throughdrying fabric and the wet web is throughdried.

9. The method of claim 8 wherein the transfer of the web from the first transfer fabric to the throughdrying fabric is carried out with a fixed gap between the transfer fabric and the throughdrying fabric, the fixed gap having a span equal to or greater than the thickness of the web leaving the transfer fabric, whereby the web is not compressed during the transfer.

* * * * *